US008006632B2

(12) United States Patent
Schlesinger

(10) Patent No.: US 8,006,632 B2
(45) Date of Patent: Aug. 30, 2011

(54) TEMPORARY PANTS HEMMING/CUFFING DEVICES

(75) Inventor: Danielle Schlesinger, Chicago, IL (US)

(73) Assignee: My Hikes, LLC, Austin, TX (US)

( * ) Notice: Subject to any disclaimer, the term of this patent is extended or adjusted under 35 U.S.C. 154(b) by 362 days.

(21) Appl. No.: 12/287,939

(22) Filed: Oct. 15, 2008

(65) Prior Publication Data

US 2009/0095207 A1 Apr. 16, 2009

Related U.S. Application Data

(60) Provisional application No. 60/999,020, filed on Oct. 15, 2007.

(51) Int. Cl.
*D05B 35/02* (2006.01)
*D05B 35/08* (2006.01)

(52) U.S. Cl. ..... 112/141; 223/35

(58) Field of Classification Search ..... 112/141, 112/147, 148, 150; 223/28–35, 37, 38; 38/69, 38/70

See application file for complete search history.

(56) References Cited

U.S. PATENT DOCUMENTS 508,735 A * 11/1893 Miller ..... 24/354
522,991 A * 7/1894 Laubin ..... 38/102
562,276 A * 6/1896 Boyd ..... 38/72
1,166,174 A * 12/1915 Bisbee ..... 223/35
2,635,368 A * 4/1953 Greb-Lasky ..... 38/70
2,767,893 A * 10/1956 Latson ..... 269/43
3,282,479 A * 11/1966 Esterbrooks ..... 223/35
3,673,641 A 7/1972 Lorber
3,713,643 A * 1/1973 Gerstenberger ..... 493/405
D235,174 S 5/1975 Gardner
4,389,755 A 6/1983 Villa-Real
4,914,791 A 4/1990 Lorber
4,934,304 A 6/1990 Rosen
4,947,524 A 8/1990 Chang
5,082,153 A * 1/1992 Duester et al. ..... 223/96
5,787,511 A 8/1998 Garside
6,618,862 B1 9/2003 Bunjes
6,865,751 B1 3/2005 Brasher
6,973,700 B2 12/2005 Hsiao

OTHER PUBLICATIONS

Internet website entitled "Paper Clips" Intp://www.officemuseum.com/paper_clips.htm, Jan. 9, 2009.

* cited by examiner

*Primary Examiner* — Ismael Izaguirre
(74) *Attorney, Agent, or Firm* — Olson & Cepuritis, Ltd.

(57) ABSTRACT

A device for temporary hemming/cuffing children's pants legs is disclosed. One embodiment of the present invention is a device having an outer body portion and an inner tongue portion connected by a hinge. The hinge creates an offset distance between the outer body and the inner tongue, and is biased to angle the inner tongue through the outer body. The inner tongue may be deflected from its neutral position to form a recess to accommodate material, such as a cuff made by turning the bottom edge of a pants leg over the pants leg. Another embodiment of the present invention is a clip having a pair of arms extending from a tongue portion. The arms are adapted to engage the bottom of a turned up edge of the pants leg thereby preventing the clip from sliding down the cuff.

18 Claims, 6 Drawing Sheets

TEMPORARY PANTS HEMMING/CUFFING DEVICES

CROSS-REFERENCE TO RELATED APPLICATION

The present application claims the benefit under 35 U.S.C. §119(e) to U.S. Provisional Patent Application No. 60/999,020 ("the '020 application"), which was filed on Oct. 15, 2007 and entitled "Temporary Pants Hemming/Cuffing Devices." The '020 application is incorporated by reference into the present application in its entirety.

FIELD OF THE INVENTION

The present invention relates generally to the field of making a hem/cuff, and more particularly to hemming devices, temporary hems, and methods for making temporary hems.

BACKGROUND OF THE INVENTION

In the clothing art, there is often a need to adjust the length of a garment. A typical way that the length of a garment has been adjusted is through the use of a hem or cuff. A hem in the clothing art has been formed by folding under or over the edge of a garment and then sewing down the edge to thereby shorten the garment.

However, there is a major drawback in the aforementioned hemming technique, in that it takes a relatively significant amount of time and effort to make the hem, such that is not suitable if one desires to make a temporary hem. This is particularly true in the case of garments for children, specifically pants for toddlers. Since children grow at a relatively fast rate, parents typically tend to buy larger size pants for the children to grow into. The pants legs are initially too long and require hemming to prevent the children from tripping over the ends of the pants and possibly injuring themselves.

Making a hem also generally requires the use of a sewing machine, which many households do not possess. One could hire a tailor to hem pants legs, but the cost of doing so is cost prohibitive for a relatively cheap garment that would only be worn for a limited time by a toddler. This cost is increased because the stitching holding the cuff must be moved in order to readjust the length of the pants once the toddler has outgrown the hemmed pants.

One way of temporarily satisfying this need for a hem is to use pins to form a temporary hem. However, use of pins on garments worn by toddlers is not safe and is to be avoided.

Another way of temporarily satisfying this need is to use clips known in the art, such as paper clips, to form a temporary hem. The use of such clips is not effective, however. Most such clips are designed to secure materials with generally thin, flat surfaces. The clips known in the art are not adapted to clip thick material with uneven surfaces such as seamed fabrics. When thick material such as a pant leg is placed between the arms of a conventional clip, the clip generally becomes misformed into a V-shape and fails to exert sufficient force to secure a pant cuff.

Accordingly, it is a general object of the present invention to provide an improved temporary hem that is easily adjustable, a method for making such a hem, and a device useful for making such a hem.

Another object of the present invention is to provide a hemming device which can be slipped over the folded-over hem, and can accommodate the side-seam located in most pants legs.

A further object of the present invention is to provide uniquely configured and aesthetically pleasing ornamental designs to be included with each hemming device.

A still further object of the present invention is to provide hemming devices which are safe to be used on toddler's garments.

SUMMARY OF THE INVENTION

The present invention is directed to hemming or cuffing devices which are safe to be used on children's garments. The term "hemming" referenced herein encompasses cuffing or other processes in which the length of a fabric is adjusted. Multiple embodiments of devices are disclosed for temporarily hemming children's pants legs.

In one preferred embodiment, the hemming device has an outer body and an inner tongue separated by a slot. The slot is generally congruent to the inner periphery of the outer body. The outer body is laterally offset from the inner tongue through a hinge member. The inner tongue is tilted and is biased to extend along a plane different than the plane of the outer body, such that a bottom portion of the tongue is located on a front side of the outer body and a top portion of the tongue is located on a rear side of the outer body. The gap between the outer member and inner tongue formed by the slot can be tapered, and is adapted to retain a temporary hemmed portion of material.

The device of this preferred embodiment can be clipped to a pant leg to form a temporary hem. The device is particularly adapted to be placed upon the outside seam portion of a pant leg. The device exerts two types of forces on the fabric of a pant leg to help ensure that the device remains attached thereto. A first force exerted by the hinge member biases the inner tongue and the outer body together to create a clamping force on the fabric. A second force exerted by the walls adjacent the slot create a pinching force on the fabric. Grip surfaces such as rubber or projections can be added to the device to increase the frictional resistance between the device and fabric material. The outer sleeve preferably contains a cutout portion to allow a side seam of a pant leg to pass through the slot with little disruption to the force exerted by the device, and to distribute the force exerted on the seam across the width of the seam.

In another embodiment of the present invention, the hemming device is a clip wherein the underlying base element is a substantially rectangular shaped member having a U-shaped slot and a T-shaped depending member with two parallel arms extending from each side of the depending member. The device is adapted to retain a temporary hemmed portion of a garment between the T-shaped member and the peripheral base portion of the clip, while the two parallel arms of the T-shaped member are adapted to engage the bottom of the folded over portion of the hem thereby retaining the clip on the garment and preventing the clip from sliding down the hem.

Decorative elements can optionally be attached to portions of any embodiment of the device of the patented invention. These decorative elements increase the attractiveness of the device, and help encourage use of the device, especially among children.

Rubber layers can also be applied to the various surfaces of the device of the present invention to increase the frictional resistance between the device and fabric. Such rubber layers also help protect a child from injury when wearing the device.

BRIEF DESCRIPTION OF THE DRAWINGS

The invention, together with the further objects and advantages thereof, may be best understood by reference to the following description taken in conjunction with the accompanying drawings, in the figures in which like reference numerals identify like elements, and in which.

DESCRIPTION OF THE PREFERRED EMBODIMENTS

Figure 1:
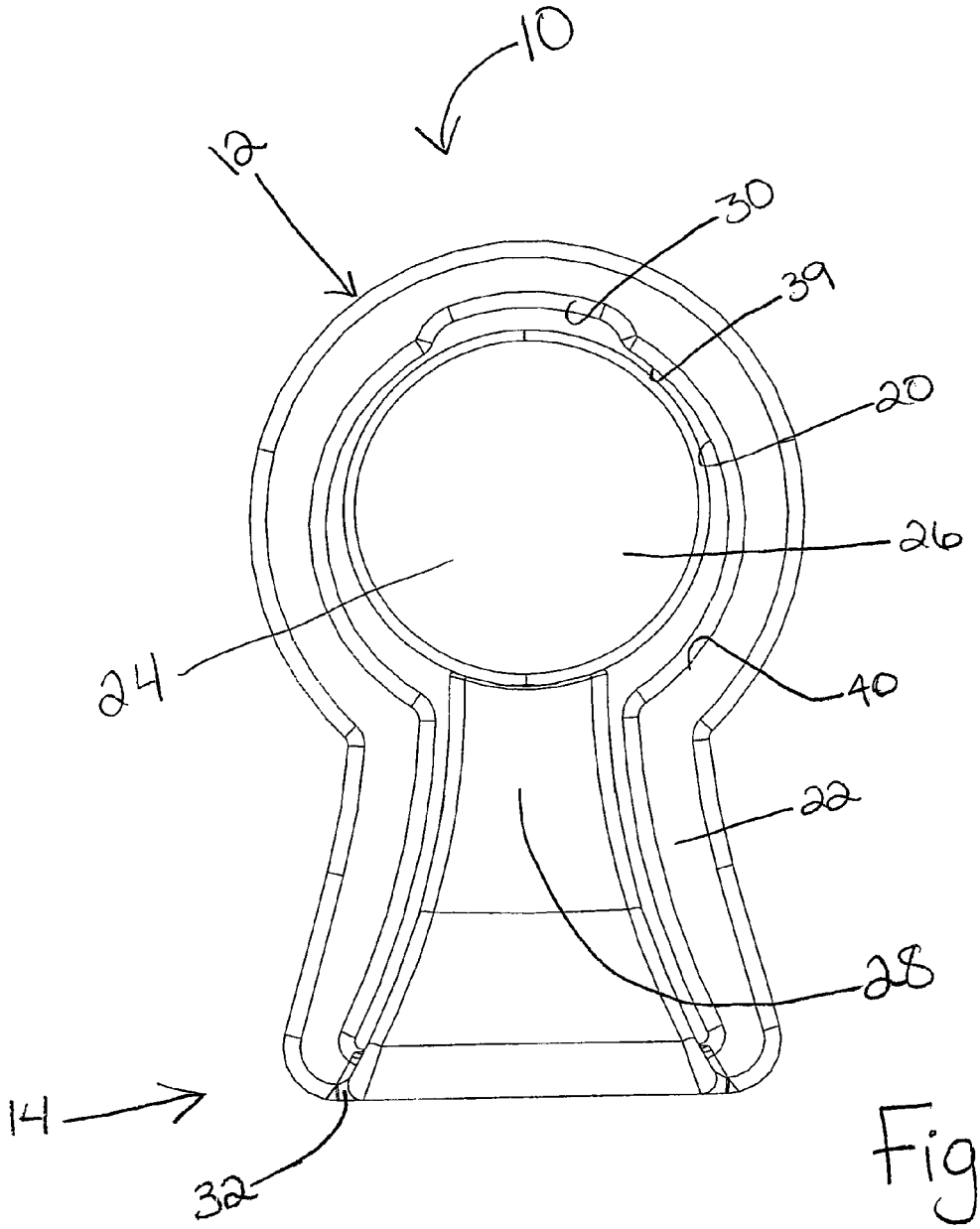
FIG. 1 is a plan front view of a hemming device proposed by the present invention.

The present invention is directed to solving the problem of temporary hemming or cuffing children's garments and specifically children's pants in a quick, safe and aesthetically appealing manner.

The invention disclosed herein is, of course, susceptible of being embodied or conducted in many different manners. Shown in the drawings and described herein below in detail are preferred embodiments of the invention. It is to be understood, however, that the present disclosure is an exemplification of the principles of the invention and does not limit the invention to the illustrated embodiments.

Referring to FIG. 1, in accordance with a preferred embodiment of the present invention, a front view of a hemming device 10 is shown. Preferably the device 10 is constructed of plastic material, and more preferably thermoplastic material. The hemming device 10 can also be constructed of other suitable materials known in the art, such as metal or wood.

With reference now to FIG. 1 through FIG. 4, the hemming device 10 has an upper side 12 and a lower side 14. In this particular embodiment the upper side has a generally rounded edge and the lower side has a generally angular edge. The present invention is not limited to these specific shapes, however, and different shape configurations of the hemming device 10 can be used.

The hemming device 10 contains a slot 20 that is generally congruent to the shape of the hemming device 10. The slot 20 extends around the majority of the periphery of the hemming device 10.

The slot 20 separates the hemming device 10 into an outer body 22 and an inner tongue 24. The inner tongue 24 is substantially planar and has a head 26 proximate the upper side 12. The inner tongue 24 has a neck 28 extending from the head 26 to the lower side 14.

The outer body 22 preferably contains a cutout 30 proximate the distal end of the head 26. This cutout 30 increases the ability of thick fabric material such as a seam to pass through slot 20 with little disruption.

Figure 2:
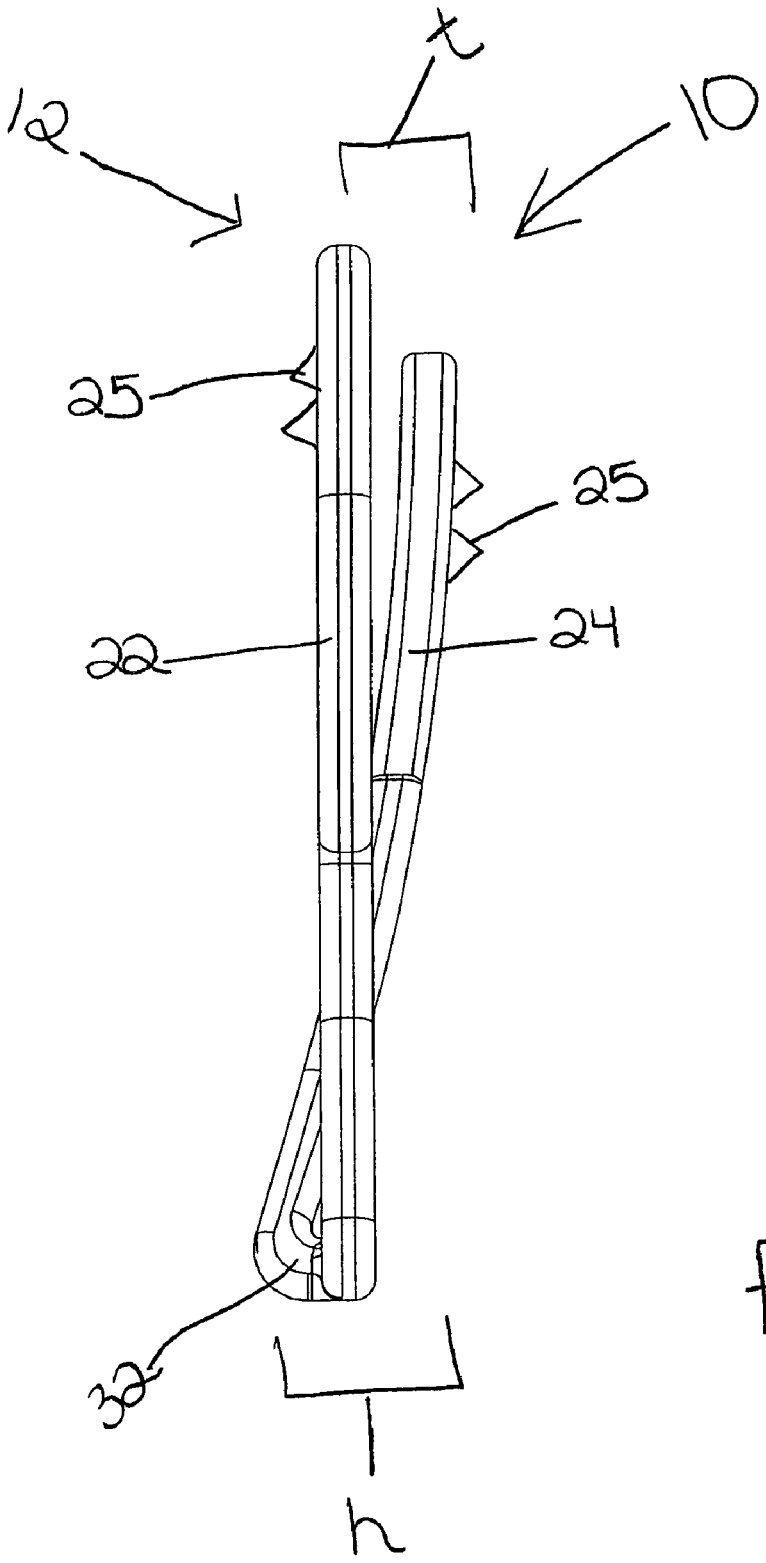
FIG. 2 is a side of the hemming device of FIG. 1.
Figure 3:
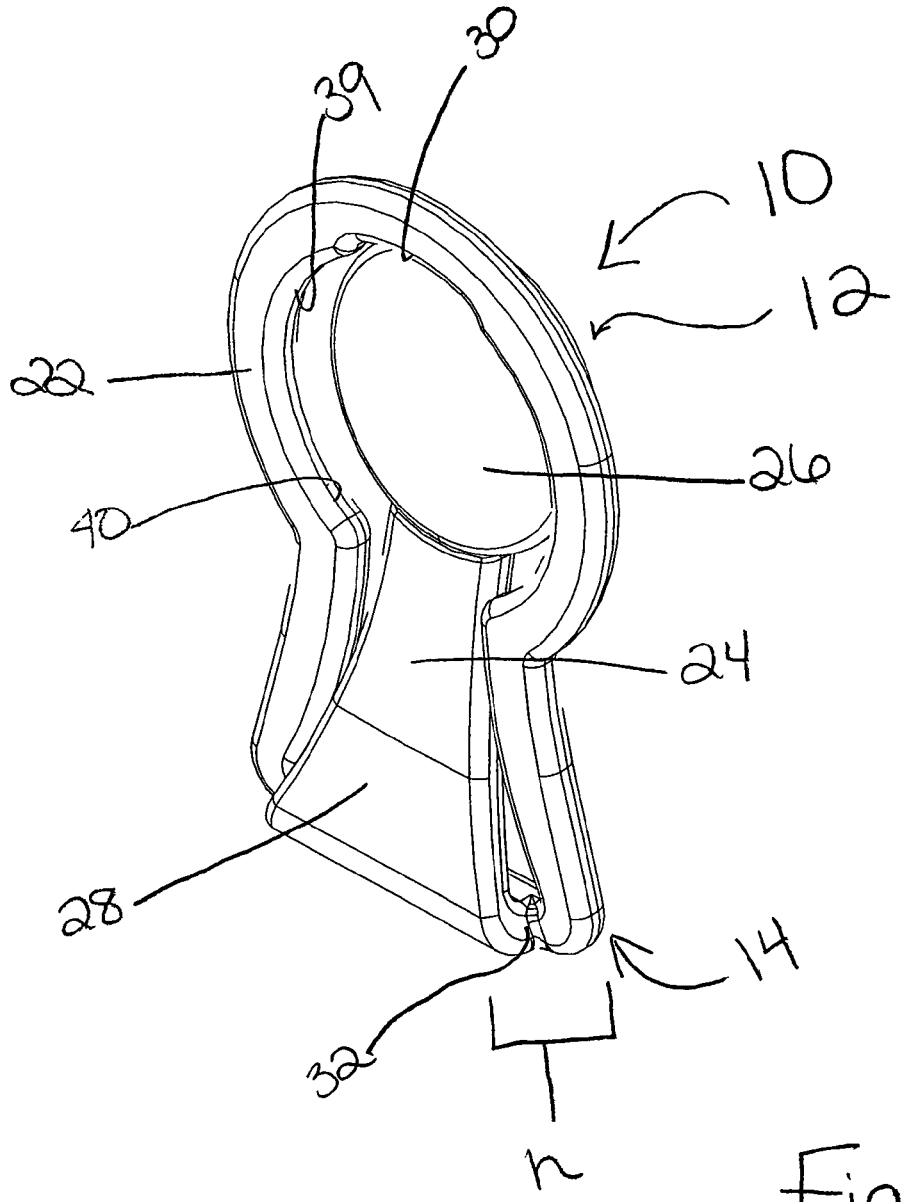
FIG. 3 is a perspective view of the hemming device of FIG. 1.
Figure 4:
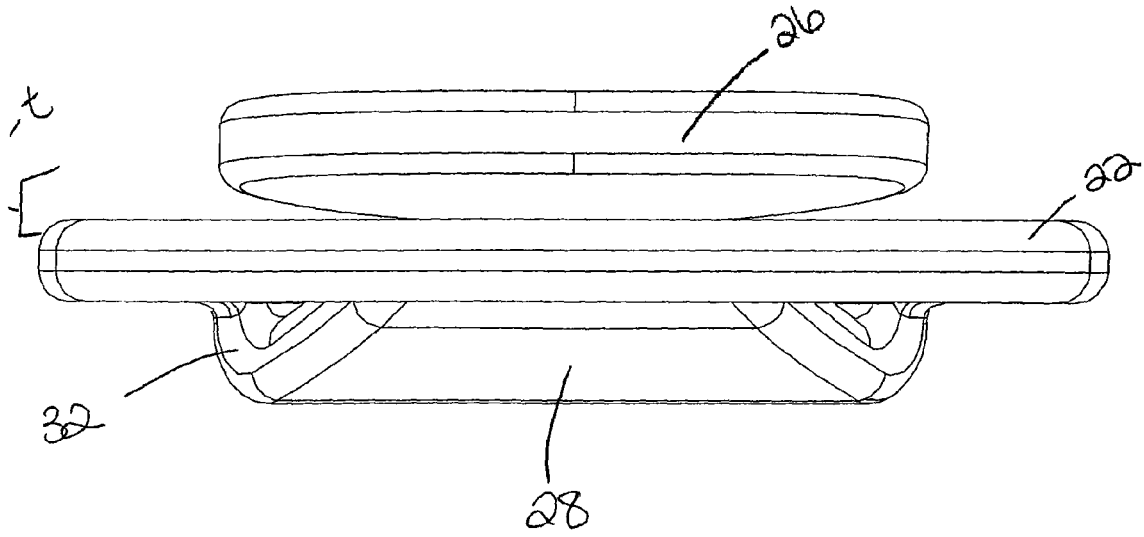
FIG. 4 is a top view of the hemming device of FIG. 1.

The inner tongue 24 and the outer body 22 are attached by a hinge 32 proximate the lower side 14. As shown in FIG. 2, the hinge 32 laterally offsets the inner tongue 24 from the outer body 22 by a distance "h". As shown below in FIG. 5, the hinge 32 provides an abutment stop for the hemmed portion of a pant leg 34 when the device 10 is attached to a pant leg.

Figure 5:
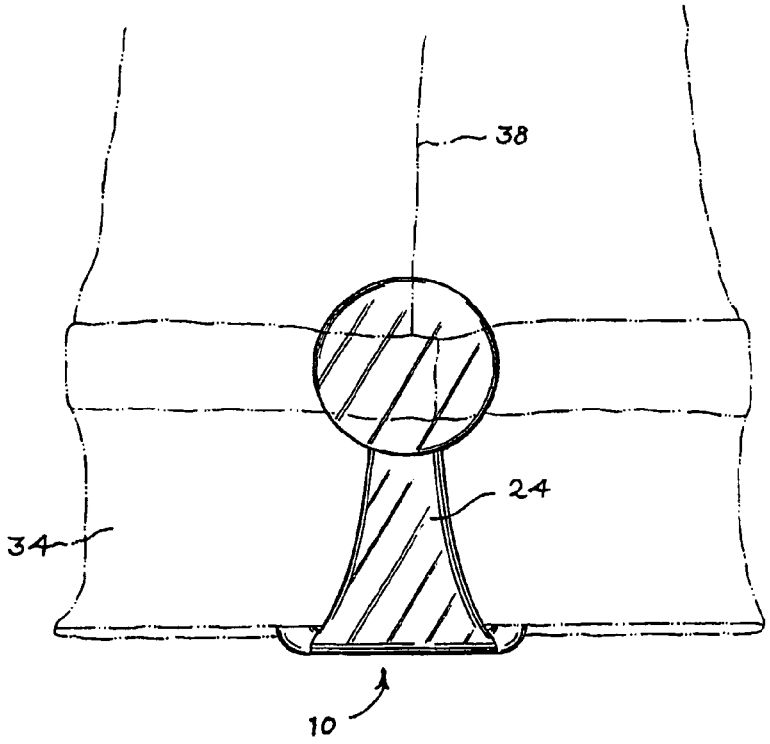
FIG. 5 shows a pant leg with a hem from the device of FIG. 1.
Figure 6:
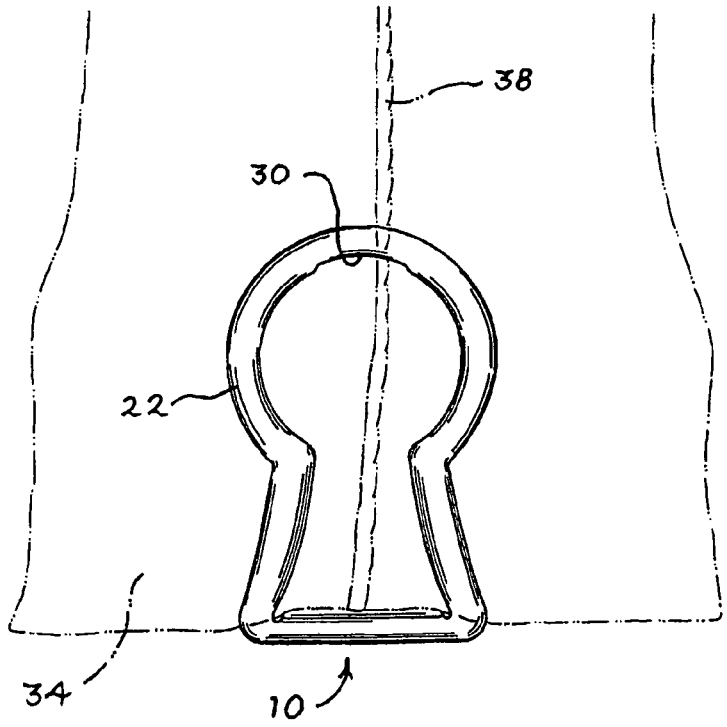
FIG. 6 shows the inside of the pant leg of FIG. 5.

The device 10 can be physically configured between an "engaged positioned" or an "unengaged position". The device 10 is in an unengaged position when the hinge 32 is in an unflexed position, such as when the device 10 is not attached to a garment. FIGS. 1-4 show the hemming device 10 in an unengaged position. The device 10 is in an engaged position when the hinge 32 is in a flexed position, such as when the device 10 is attached to a garment. FIGS. 5-6 show the hemming device 10 in an engaged position.

In the unengaged position, the unflexed hinge 32 tilts the inner tongue 24 along a plane different from the plane of the outer body 22. As a result of this tilt, inner tongue 24 extends through the outer body 22 so that the head 26 is located on the rear side of the outer body 22 while the bottom of the tongue 24 is located on the front side of the outer body 22. In the unengaged position, the head 26 of the inner tongue 24 extends behind the plane of the outer body 22 by a distance "t".

To place device 10 into the engaged position, the inner tongue 24 is displaced toward the front of the device 10 by applying force to overcome the bias of hinge 32. This displacement of the inner tongue 24 provides a receiving recess between tongue 24 and outer body 22 which allows the hemmed portion of the pant leg to be inserted and frictionally held by the cooperation of the tongue 24 and outer body 22.

The offset distance "h" and the pass-through distance "t" created by the hinge 32 optimize the hemming device's 10 ability to clip fabric.

The pass-through distance "t" maximizes the clamping force present at the top side 12 of the device 10, by biasing the head 26 into a position toward the outer body 22. Without this pass-through distance "t" the amount of clamping force at the top side 12 of the device 10 would be reduced.

The offset distance "h" provides clearance to allow garment material to be inserted into the hemming device 10 without creating an unstable "V"-type structure. Without this offset distance "h", the insertion of material into the device 10 would separate the outer body 22 from the inner tongue 24 at the lower side 14, resulting in a loss of clamping force at the top side 12 of the device 10. In a preferred embodiment, the distance "h" is about 4 millimeters to about 50 millimeters.

The offset distance "h" is particularly important when the hemming device 10 is placed on the outside seam of a pant leg 34. As shown in FIGS. 5 and 6, the device 10 must accommodate the thickness of the fabric when the device is used to create a temporary seam on a pant leg. The device 10 is preferably attached proximate the outside seam location 38 of a pant leg 34. The location proximate the outside seam 38 is the bulkiest portion of the pant leg 34 because it contains the outside seam 38 as well as folded cuff fabric. The multiple layers of fabric present in this location have a thickness that are multiple times more than the thickness of the garment fabric itself. Offset distance "h" provides clearance to accommodate the fabric bulk at proximate the outside seam 38.

Placing the outside seam 38 into cutout 30 allows the side seam to pass through the slot 20 with little disruption to the clamping force of the hinge 32.

Placing the device 10 proximate the outside seam 38 is preferable because the device 10 is less likely to contact the foot during foot movement. The foot moves up and down during walking and other exercise, and would likely contact a device 10 placed on the front or rear of the pant leg. A device 10 placed on the inside of the pant leg would likely contact another device 10 placed on the inside of the opposite pant leg, which could result in undesired contact of two devices used on opposite legs of the same pants.

Placing the device 10 proximate the outside seam 38 also optimizes the performance of the device 10. When the device 10 is placed in this location, the outside seam 38 is inserted into cutout 30. This placement of the outside seam 38 into cutout 30 prevents the device 10 from slipping laterally while being worn. Placing the outside seam 38 into cutout 30 also increases friction between the pant leg and the device 10, which increases the clamping strength of the device 10. The "open-back" configuration of device 10 is particularly appropriate for use with an outside seam 38. The outside seam 38 runs along the rear side of the inner tongue 24 without contacting the outer body 22 until the outside seam 38 enters through the slot 20 at the cutout 30.

Finally, placing the device 10 on the outside of the pant leg is desirable from a fashion standpoint, because this location allows a device 10 decorated with an embellishment to be fully exposed and viewable.

The gap between the outer body 22 and the inner tongue 24 created by the slot 20 also optimizes the hemming device's 10 ability to attach to pant leg material. In one preferred embodiment, the slot 20 forms a tapered gap such that the distance between the outer body 22 and the inner tongue 24 is greater adjacent the lower side 14 than adjacent the the upper side 12.

With reference now to FIG. 1, the narrow gap region 39 proximate the distal end of the head 26 is smaller than the wide gap region 40 proximate the upper portion of the neck 28. In one embodiment, the inner tongue 24 and the outer body 22 are separated in the narrow gap region 39 by a distance about equal to the thickness of fabric being hemmed. The inner tongue 24 and the outer body 22 are separated in the wide gap region 40 by a distance about equal to four times the thickness of the fabric being hemmed. In a particularly preferred embodiment of the present invention, the slot 20 varies in size from about 0.5 millimeters to about 5 millimeters. The size range of the slot 20 can be varied to accommodate fabrics having a variety of lengths and thicknesses.

A slot 20 having a tapered alignment increases the versatility of the device 10, because a variety of fabric types with various thicknesses can be secured with the same device. The fabric being hemmed can be placed into the appropriate section of the slot 20 so that thick portions of fabric can pass through the slot 20 without forcing open the hinge 32 to accommodate fabric thickness and reducing the force exerted by the device on the fabric. In another embodiment (not shown), the slot 20 forms an non-tapered gap such that the distance between the outer body 22 and the inner tongue 24 is constant throughout portions of the gap. The distance outer body 22 and the inner tongue 24 can be constant throughout the entire gap, or multiple fixed distances can occur in various locations in the gap. This embodiment can be used with fabric of a specific thickness that complements the size of the gap formed from the slot 20, such that fabric having a specific thickness can pass through the slot 20 without forcing open the hinge 32 to accommodate fabric thickness.

The slot 20 provides additional force on the fabric by frictionally restraining the fabric between the inner tongue 24 and the outer body 22. Specifically, the portion of the neck 28 below the head 26 of the inner tongue 24 is typically the portion of the device 10 that frictionally restrains fabric between the inner tongue 24 and the outer body 22. In most pant leg constructions, a constant and predictable fabric thickness is located on either side of side seam 38. In this particular embodiment of the present invention, the width of neck 28 is slightly larger than the width of side seam 38. As such, the fabric located on either side of side seam 38 contacts device 10 at the portion of the neck 28 below the head 26 of the inner tongue 24. The slot 20 frictionally restrains the fabric at the neck 28 below the head 26. The tapered gap of the slot 20 above the neck 28 allows the thicker portions of the fabric to pass through the slot 20 without disrupting the frictional force exerted on the fabric at the neck 28 below the head 26 of the inner tongue 24.

As described, the device 10 exerts two forces on the fabric of a pant leg in order to optimize its ability to function as a hem. The first force is a clamping force exerted by the hinge 32. The clamping force biases the inner tongue 24 toward the outer body 22, and fabric between these two elements is clamped. The second force is a lateral pinching force exerted on the fabric when it passes through the slot 20. The edges of the outer body 22 and inner tongue 24 proximate the slot 20 exert a pinching force on fabric located in the slot 20.

The clamping force and the pinching force are both generally greatest at the portion of the neck 28 below the head 26 of the inner tongue 24. The clamping force is greatest in this location because this is generally where the inner tongue 22 passes through the outer body 22. The pinching force is also greatest in this location because this is where the fabric located on either side of side seam 38 passes through slot 20. Preferably, bulky portions of fabric such as a hem are placed above the neck 28. In this way, the clamping and pinching forces present at the neck 28 below the head 26 of the inner tongue 24 are not disrupted. Generally, the device 10 exerts most force on fabric located between the neck 28 and the hinge 32.

The forces exerted by the device 10 can be further optimized by placing rubber material on various portions of the device 10 to increase the frictional resistance created when fabric contacts the device 10. For example, the head 26 can be covered with rubber to optimize the frictional force created between the device 10 and the pant leg 34 when the hinge 32 exerts clamping force on inner tongue 24. Similarly, projections 25 can be placed on the surface of the inner tongue 24 or outer body 22 in order to increase frictional resistance between fabric and the device 10.

The edges of the device 10 nearest the slot 20 (e.g. the inner edge of the outer body 22 and the outer edge of the inner tongue 24) can be covered with rubber to increase the frictional force created when fabric is placed into the gap created by the slot 20.

Adding rubber to the surface of the device 10 also increases the safety of the device. The increased friction created by the rubber layers reduces the chances that a child will be able to remove the device from the pant leg. If a child is able to remove the device 10 and place it into his or her mouth, the rubber layer will reduce the chances that the child's mouth will be cut or the child's teeth will be damaged.

Any type of rubber material known in the art can be used with the present invention. For example, thermoplastic elastomer, thermoplastic urethane or thermoplastic rubber can be used with the present invention. In particular, commercially available thermoplastic materials such as SANTOPRENE® or PELLETHANE® can be used with the present invention.

Decorative embellishments may be added to the device 10 to increase the attractiveness of the device to children. For example, a plurality of hearts, geometric shapes, sports logos, animals or the like may be attached or molded onto the head 26 or the neck 28 of the inner tongue 24. When the device 10 is attached proximate the outside seam 38 of a pant leg 34, these decorative embellishments are exposed and viewable.

A method for forming a temporary hem on the pant leg includes folding an edge of the pant leg to form a folded edge to shorten the pant leg, and placing the device 10 over the folded portion such that the folded portion is received and held by the recess formed between the inner tongue 24 and outer body 22.

Figure 7:
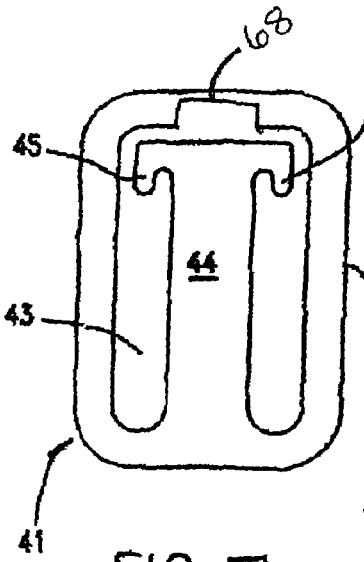
FIG. 7 is a plan view of a second device proposed by the present invention.
Figure 8:
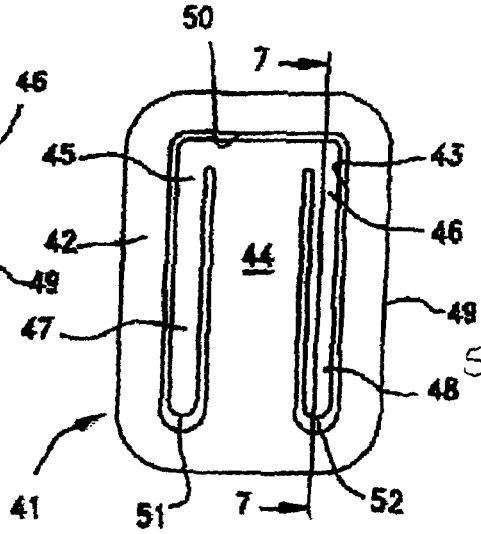
FIG. 8 shows the device of FIG. 7 with elongated arms.

Referring to FIGS. 7 through 11, another embodiment of the invention is depicted, wherein, a clip 41 as shown in FIG. 7 has a body member 42 formed into a substantially rectangular shape. The body member 42 has an inner set U-shaped slot 43 and an approximately T-shaped dependent tongue portion 44 with parallel dependent arms 45 and 46 extending into the slot 43. Extended arms 47 and 48 can extend from arms 45 and 46, respectively. Extended arms 47 and 48 extend into the slot 43 and have properties which allow the arms to be easily manipulated out of the plane of clip 41, as well as tongue 44. The slot 43 is generally parallel to the outer periphery 49 of the body member 42. Body member 42 may contain a seam recess 68. The entire clip 41 may be molded of plastic material and may be over-molded with a layer of thermoplastic-type material such as SANTOPRENE® or PELLETHANE® to provide non-slippery, soft surfaces between the garment and leg portion of the pants-wearer.

Figure 10:
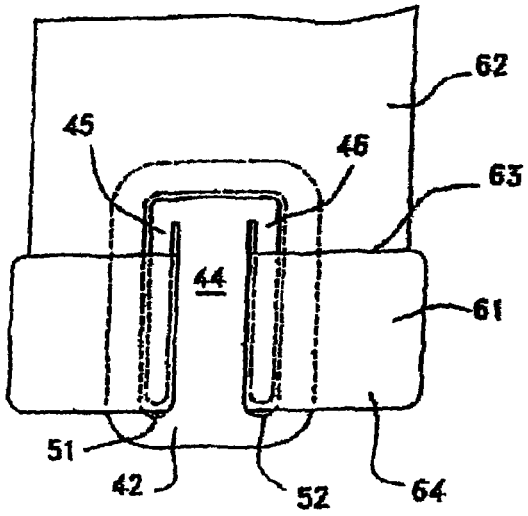
FIG. 10 shows a pant leg with a hem proposed by the present invention using the device of FIG. 7.

A method for forming a temporary hemming portion or cuff 61 on a pants leg 62 to shorten the pants leg, as shown in FIG. 10, includes folding the bottom edge 63 of the pants leg 62 over the pants leg 62 creating thereby a new bottom edge 64. Just as in the previous embodiment, the clip 41 is constructed of material sufficiently pliable to allow tongue 44 with respective arms 45 and 46 and extended arms 47 and 48 to deflect out of the plane of contiguous body member 42 so as to provide a receiving recess 50 between the tongue 44 and body member 42 into which the hemmed portion 61 of the pants leg 62 is received. The cuffed portion is generally inserted into the recess 50 until the bottom edge of the cuff abuts the termini 51 and 52 of slot 43. After the cuffed portion 61 is properly inserted into the recess 50, the extended arms 47 and 48 are deflected out of the plane of tongue 44 and may be inserted between the top edge 63 of the cuff 61 and the pants leg 62 until they substantially bottom out at the bottom of the folded over cuff, as shown by the hidden lines in FIG. 10. Positioning of the arms 47 and 48 inside the folded over portion of the cuff enables the clip 41 to be secured to the pants leg and prevents the clip from sliding down the cuff 61.

The body shape of clip 41 shown in FIGS. 7-11 can be combined with a hinge creating a lateral offset between body member 42 and the tongue portion 44, similar to the hinge 32 described above. Such a hinge can bias the tongue portion 44 through the body member 42 as also described above. Finally, the slot 43 can be tapered and adapted to receive fabrics of various thicknesses, similar to the slot 20 described above.

Figure 9:
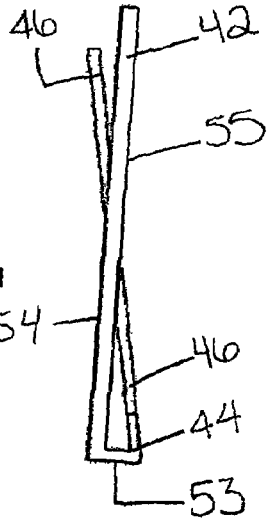
FIG. 9 is a side view of FIG. 8.

Such a configuration is shown in FIG. 9. In this configuration, the body member 42 is attached to tongue portion 44 through a hinge 53. The hinge 53 creates an offset distance between body member 42 and tongue portion 44. The hinge 53 angles the tongue portion 44 so that the portion of the tongue 44 adjacent the arm 46 is on a rear side 54 of body member 42, and the portion of the tongue 44 adjacent the hinge 53 is on a front side 55 of body member 42.

Figure 11:
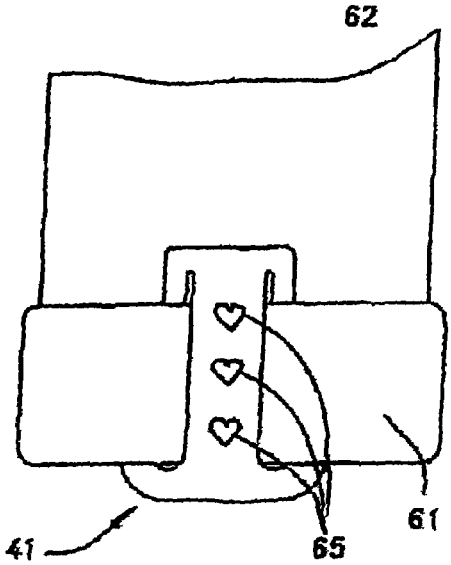
FIG. 11 shows the hemming device of FIG. 10 incorporating an ornamental design.

While the clip 41 is preferably molded from pliable plastic, it may be made from sufficiently rigid rubber type material, or any other pliable material such as metal and then optionally covered by a rubber or thermoplastic type material. For decorative purpose an ornamental design such as depicting a plurality of hearts 65, may be affixed or molded onto clip 41 as shown in FIG. 11.

The present invention is discussed in the context of pant legs, but of course, can also be used with any other material or fabric. Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A hemming device detachably securable to a material, the hemming device comprising:

a longitudinally extending outer body having a distal end portion and a base portion, and defining an opening, wherein the outer body distal end portion comprises a seam recess;

a longitudinally extending and substantially planar tongue having a first end and a second end; and a hinge connecting the outer body base portion and the second end of the tongue, the outer body base portion being offset via the hinge from the second end of the tongue in a direction substantially perpendicular to the base portion, the hinge biased to position the tongue to extend from the second end through the opening when detached from the material, the hinge enabling the tongue to be displaced out of the opening so as to define a receiving recess bounded by the tongue, the outer body, and the hinge, such that the material may be received and detachably secured within the receiving recess.

2. The hemming device of claim 1, wherein the outer body, tongue and hinge are of integral construction.

3. The hemming device of claim 1, wherein the opening is of a general keyhole shape and the tongue has a shape generally complementary to the keyhole shape wherein the first end of the tongue is generally round and the second end of the tongue is elongated.

4. The hemming device of claim 1, wherein the tongue and the outer body define a tapered slot generally congruent to an inner periphery of the outer body.

5. The hemming device of claim 4, wherein the tapered slot is configured to frictionally secure materials having a variety of thickness.

6. The hemming device of claim 4, wherein the tapered slot varies in size from about 0.5 millimeters proximate the distal end portion of the outer body to about 5 millimeters proximate the base portion of the outer body.

7. The hemming device of claim 1, wherein the outer body distal end portion is substantially round.

8. The hemming device of claim 1, wherein the second end of the tongue is a generally circular shape.

9. The hemming device of claim 1, further comprising a grip layer on at least a portion of one or more of the outer body and tongue.

10. The hemming device of claim 1, further comprising grip projections on at least a portion of one or more of the outer body and tongue.

11. A device for engaging one or more layers of fabric comprising:

a longitudinally extending outer body having a distal end portion and a base portion, wherein the outer body distal end portion comprises a seam recess;

a longitudinally extending and substantially planar tongue having a first end and a second end;

a hinge connecting the outer body base portion and the second end of the tongue, the outer body base portion being offset from the second end of the tongue in a direction substantially perpendicular to the base portion;

the hinge biased to position the first end of the tongue on a rear side of the outer body and the second end of the tongue on a front side of the outer body; and the tongue and the outer body defining a tapered slot generally congruent to a periphery of the outer body, wherein the tapered slot is configured to receive material and to frictionally engage the material between the tongue and the outer body.

12. The device of claim 11, wherein the distance between the outer body and the tongue proximate the tapered slot varies between about 0.5 millimeters and about 5 millimeters.

13. The device of claim 11, wherein the distance between the outer body and the tongue proximate the tapered slot is generally constant.

14. The device of claim 11, further comprising a grip layer on at least a portion of one or more of the outer body and tongue.

15. The device of claim 14, wherein the grip layer is comprised of rubber.

16. A hemming device detachably securable to a material, the hemming device comprising:

a longitudinally extending and substantially planar outer body having a length extending from a distal end portion to a base portion and width that is smallest at a point about midway between the distal end portion and the base portion;

the distal end portion being generally round and the base portion being generally angular;

the outer body defining a generally keyhole shaped opening;

a longitudinally extending and substantially planar tongue having a generally circular first end and a generally elongated second end and a tongue transition point between the first end and second end;

the tongue having a size smaller than the outer body and a shape generally complementary to the outer body;

a hinge attaching the outer body base portion and the second end of the tongue;

the hinge having a width between about 4 millimeters and about 30 millimeters;

the outer body base portion being offset via the hinge from the second end of the tongue in distance equal to the width of the hinge and in a direction substantially perpendicular to the base portion;

the hinge biased to position the tongue to extend from the second end through the opening when detached from the material, such that the tongue passes through the outer body proximate the tongue transition point, the hinge enabling the tongue to be displaced out of the opening so as to define a receiving recess bounded by the tongue, the outer body, and the hinge, such that the material may be received and detachably secured within the receiving recess.

17. A hemming device detachably securable to a material, the hemming device comprising:

a longitudinally extending outer body having a distal end portion and a base portion, and defining a generally U-shaped opening;

a longitudinally extending and substantially planar tongue having a first end and a second end; wherein the tongue is generally T-shaped, and the tongue further comprises parallel dependent arms extending proximally from the first end of the tongue, and a hinge connecting the outer body base portion and the second end of the tongue, the outer body base portion being offset via the hinge from the second end of the tongue in a direction substantially perpendicular to the base portion, the hinge biased to position the tongue to extend from the second end through the opening when detached from the material, the hinge enabling the tongue to be displaced out of the opening so as to define a receiving recess bounded by the tongue, the outer body, and the hinge, such that the material may be received and detachably secured within the receiving recess.

18. The hemming device of claim 17, wherein the parallel dependent arms terminate at a point adjacent the second end of the tongue.

* * * * *